US009068805B2

(12) United States Patent
Owen

(10) Patent No.: US 9,068,805 B2
(45) Date of Patent: Jun. 30, 2015

(54) ARROW MODIFICATION AND FLETCHING SYSTEM

(71) Applicant: Matthew James Owen, Oviedo, FL (US)

(72) Inventor: Matthew James Owen, Oviedo, FL (US)

( * ) Notice: Subject to any disclaimer, the term of this patent is extended or adjusted under 35 U.S.C. 154(b) by 0 days.

(21) Appl. No.: 14/308,704

(22) Filed: Jun. 18, 2014

(65) Prior Publication Data

US 2015/0005115 A1 Jan. 1, 2015

Related U.S. Application Data

(60) Provisional application No. 61/839,384, filed on Jun. 26, 2013.

(51) Int. Cl.
*F42B 6/06* (2006.01)
*F42B 6/04* (2006.01)

(52) U.S. Cl.
CPC ... *F42B 6/06* (2013.01); *F42B 6/04* (2013.01); *Y10T 29/4973* (2015.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 3,401,938 | A * | 9/1968 | Bear | 473/582 |
| 7,935,012 | B2 * | 5/2011 | Lee | 473/578 |
| 2009/0163308 | A1 * | 6/2009 | Odabachian et al. | 473/582 |
| 2012/0021856 | A1 * | 1/2012 | Mackey et al. | 473/585 |

* cited by examiner

*Primary Examiner* — John Ricci
(74) *Attorney, Agent, or Firm* — Sandra L. Layer

(57) ABSTRACT

An Arrow modification and fletching system wherein an adapter is used to modify modern hollow carbon arrows creating a fletched end module for the purpose of facilitating arrow modification and fletch repair and replacement.

5 Claims, 3 Drawing Sheets

ARROW MODIFICATION AND FLETCHING SYSTEM

RELATED APPLICATION

The present patent application claims priority to the corresponding provisional patent application Ser. No. 61/839,384 entitled "Arrow Modification and Fletching System" filed on Jun. 26, 2013.

FIELD OF THE INVENTION

The present invention relates to an Arrow Modification and Fletching System and more particularly pertains to system for facilitating arrow modification and fletch repair and replacement.

Archery is the sport of bows and arrows. There are several modern goals to the sport. There is target and Olympic archery which is archery for the sake of score. There are also recreational hunters in archery that enjoy the more primitive and skilled style of hunting. In both respects archers have over the years developed ever more advanced gear. Further, arrows have gone through a series of developments over the past years. Arrows were traditionally wood with feathers tied on or glued on as time went on. Over time arrows were introduced as aluminum tubes, then in the 1980's, carbon mesh wrapped in layers, became the new shaft. This made the arrow much quicker, but lost the accuracy of a slower arrow. Now there are modern arrows with an aluminum core tube and a carbon over sleeve makingthe arrow weigh more and yet have the speed of carbon while addressing problems with crooks developing in aluminum from impact.

Arrow heads have likewise undergone changes from early flint arrow heads. Some arrow heads are more permanent using molded lead tips permanently adhered in place. There are now angled razors for hunting. The latest arrow heads use a screw in attachment system, where the bottom of the arrow tip has a male screw and threads into a receiving insert that is a permanent addition to the arrow and is adhered into the tube.

There has always been the problem of what to do when one botches an arrow, stripping the arrow in some manner of the feathers, also called vanes or fletching.

Traditionally and now, in order to repair the arrow all three vanes would need to be taken off and re-adhered to the shaft. This takes time and skill. The repair would require shaving off the remaining vanes and what was left of the damaged vane. A precision device and know-how is required to re-adhere vanes back in a proper fashion.

Over time, jigs have been developed to perform the task of gluing more vanes to the shaft, more efficiently and precisely. They accommodate a single vane, all three of one, or lastly multiple arrows one side at a time. This still is not a process that could be performed in the field. No matter how an archer approaches fletching an arrow or fletching any number of arrows, it is extremely time consuming and is even slightly technical. Technical concerns include which direction is best for helical and is offset better than helical?

This is the dilemma that is presented to all archers no matter the cause. Archers are faced with either replacing the arrow all together, or re-fletching. Re-fletching is impossible while out hunting so archers are simply out of an arrow if a vane is lost.

The Arrow Modification and Fletching System described herein is an invention meant to be used with modern carbon arrows. The purpose of the Arrow Modification and Fletching System is to reduce arrow down time due to damaged fletching. Said in another way, this invention makes the fletched end a module that screws in much like field points. When a fletching is lost, the module is simply replaced. This in effect makes an arrow with stripped fletching less of a problem and useable in less time.

Description of the Prior Art

The use of arrow modification and fletching repair and replacement systems is known in the prior art. More specifically, arrow modification and fletching replacement systems previously devised and utilized for the purpose of replacing fletching are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,074,143 issued Jul. 11, 2006 to Czemske and Smith relates to an Arrow Fletching System and Method for Attaching Arrow Fletching System to an Arrow Shaft and U.S. Pat. No. 6,695,727 issued Feb. 24, 2004 to Kuhn and relates to an Arrow Vane Device.

While these devices fulfill their respective, particular objectives and requirements, the aforementioned patents do not describe an Arrow Modification and Fletching System that facilitates arrow modification and fletching repair and replacement in a manner that is both flexible and convenient using standard modern carbon arrows.

The Arrow Modification and Fletching System described herein is an invention meant to be used with modern carbon arrows. The purpose of the Arrow Modification and Fletching System is to reduce arrow down time due to fletching. Said in another way, this invention makes the fletched end a module that screws in much like field points. When a fletching is lost, the module is simply replaced. This in effect makes an arrow with stripped fletching less of a problem and useable in less time. In addition, the system allows for the modification and adaptation of the arrow for the purpose of changing length and fletching characteristics. This invention also provides an improved method of connecting the modified arrow to facilitate fletching repair.

In this respect, the Arrow Modification and Fletching System according to the present invention substantially departs from the conventional concepts and designs of the prior art, and in doing so provides an apparatus primarily developed for the purpose of system for facilitating arrow modification and fletch repair and replacement.

Therefore, it can be appreciated that there exists a continuing need for a new and improved Arrow Modification and Fletching System which can be used for facilitating arrow modification and fletching repair and replacement. In this regard, the present invention substantially fulfills this need.

SUMMARY OF THE INVENTION

In view of the foregoing disadvantages inherent in the known types of fletching replacement systems now present in the prior art, the present invention provides an improved Arrow Modification and Fletching System. As such, the general purpose of the present invention, which will be described subsequently in greater detail, is to provide a new and improved Arrow Modification and Fletching System and method which has all the advantages of the prior art and none of the disadvantages.

To attain this, the present invention essentially comprises an intermediate component functioning as an adapter. The present invention further comprises a rear component functioning as a fletching module and still further comprises a front component having a shaft with a leading end having a point.

The adapter is an elongated male/male adapter having a center flange forming a flat abutment on either side for the purpose of capping an arrow shaft and eliminating gaps when assembled. One side, the side that is affixed to the fletching end module is formed with the hollow cylindrical configuration of a shaft insert. The other side is formed with a shank and a male threaded end. The center flange has the ID of a standard arrow. The flange includes a recessed groove capable of receiving an O-ring on the side facing the shank and male threaded end. An O-ring is installed in the groove. The male threaded end is configured to be screwed into a female threaded insert, which is a common tip insert. The O-ring forms a frictional locking mechanism between the flange of the adapter and the female threaded insert. The adapter is formed of a rigid material taken from a class of rigid materials including aluminum, titanium, stell and hard plastics. The fletching module has an arrangement of fletching pre glued to it and a nock on one end. The end of the fletching module opposite of the nock is adapted to receive the end of the adapter formed as the shaft insert. The shaft insert is adhesively attached to the fletching module. The shaft of the fletching module has the same I.D. of any normal arrow shaft so any standard arrow can be used in conjunction with the module. The end of the front component opposite the point is adapted to receive a female threaded shaft insert in order to couple with the male threaded end of the adapter.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Arrow Modification and Fletching System which has all of the advantages of the prior art fletching replacement systems and none of the disadvantages.

It is another object of the present invention to provide a new and improved Arrow Modification and Fletching System which may be easily and efficiently manufactured and marketed.

It is further object of the present invention to provide a new and improved Arrow Modification and Fletching System which is of durable and reliable constructions.

An even further object of the present invention is to provide a new and improved Arrow Modification and Fletching System which is susceptible of a low cost of manufacture with regard to both materials and labor, and which accordingly is then susceptible to low prices of sale to the consuming public, thereby making such Arrow Modification and Fletching System economically available to the buying public.

An even further object of the present invention is to provide a means to repair and modify standard arrows reducing down time due to damage.

Even still another object of the present invention is to provide an Arrow Modification and Fletching System for facilitating arrow modification and fletching repair and replacement which can be performed quickly and easily in the field.

An even still further object of this invention is to provide an Arrow Modification and Fletching System for facilitating arrow modification and fletching repair and replacement with an improved coupling of the fletching module to the arrow.

Still further, it is an object of the present invention to provide a new and improved arrow modification and fletching system that allows for the modification and adaptation of the arrow for the purpose of changing length and fletching characteristics.

Lastly, it is an object of the present invention to provide an adapter used to modify modern hollow carbon arrows creating a fletched end module for the purpose of facilitating arrow modification and fletch repair and replacement.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
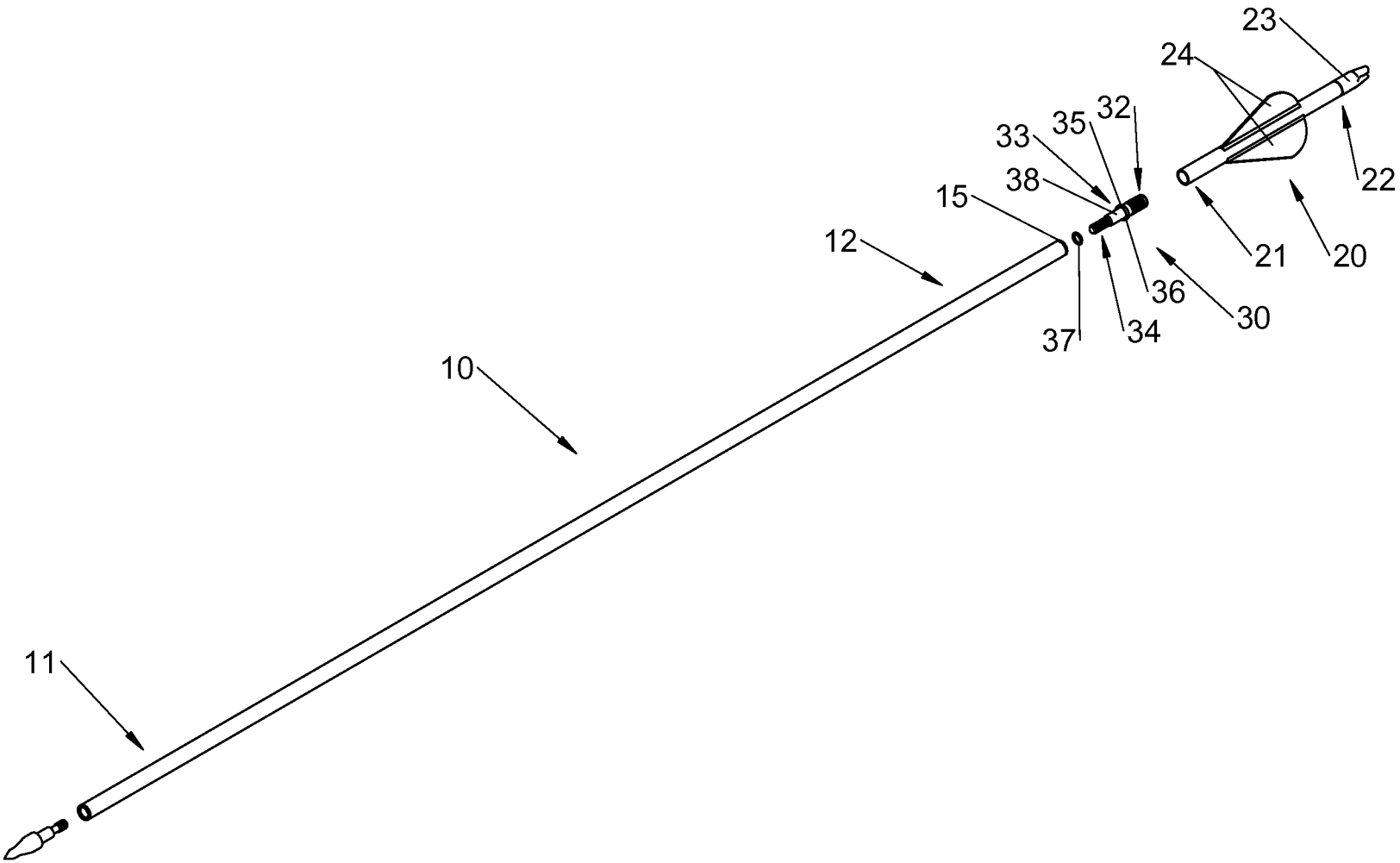
FIG. 1 is a partially exploded view of an Arrow Modification and Fletching System constructed in accordance with the principles of the present invention.
Figure 2:
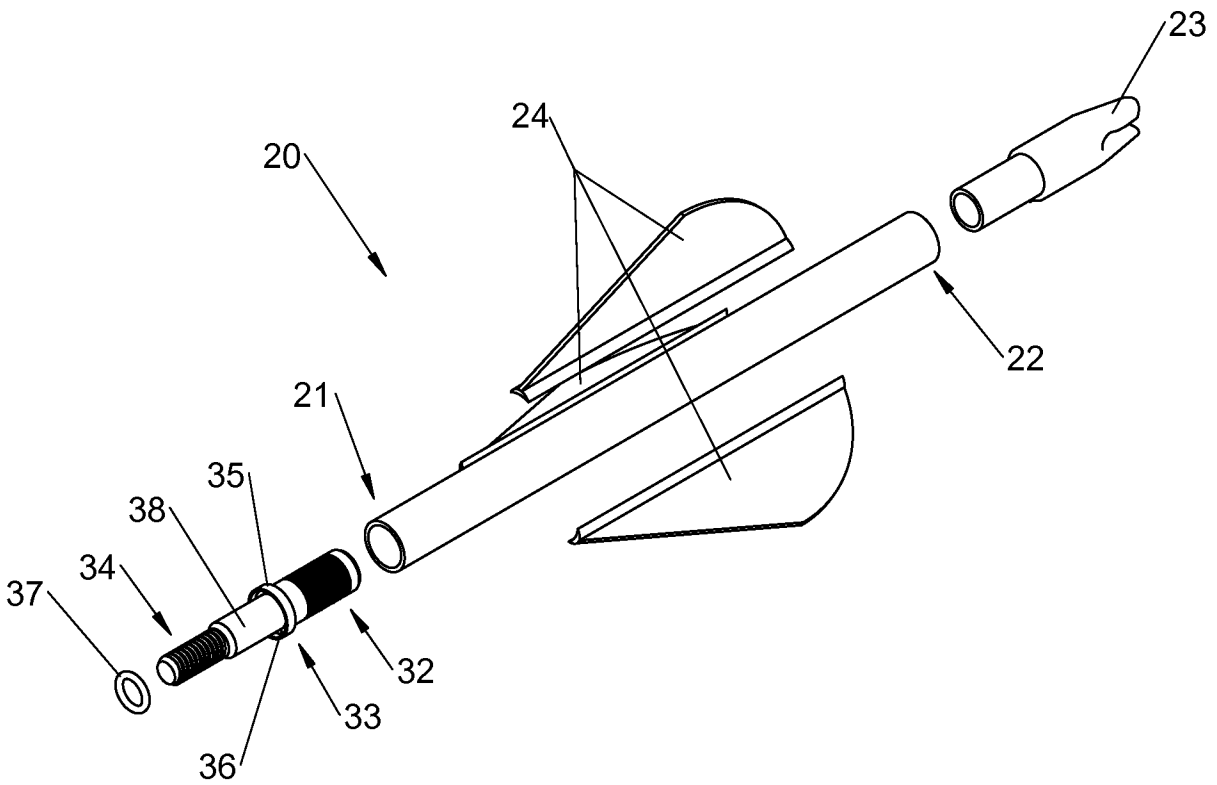
FIG. 2 is an explode view of the rear component of an Arrow Modification and Fletching System constructed in accordance with the principles of the present invention.
Figure 3:
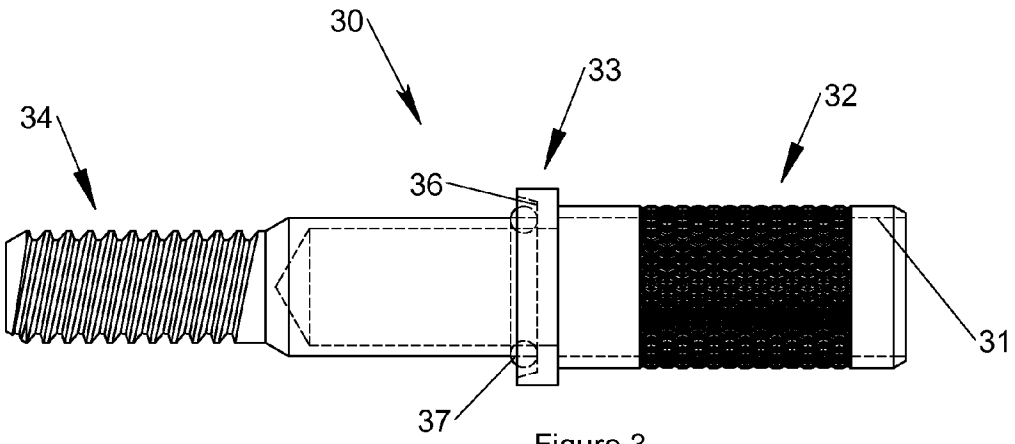
FIG. 3 is a cross sectional view of the adapter component of an Arrow Modification and Fletching System constructed in accordance with the principles of the present invention.
Figure 4:
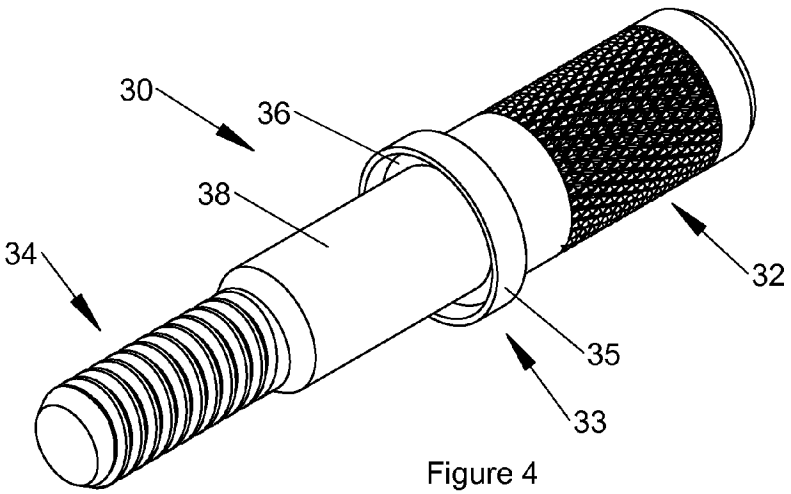
FIG. 4 is a front elevational view of the adapter component of an Arrow Modification and Fletching System constructed in accordance with the principles of the present invention.

With reference now to the drawings, and in particular to FIGS. 1-4 thereof, the preferred embodiment of the new and improved Arrow Modification and Fletching System embodying the principles and concepts of the present invention and generally designated by the reference numeral 10 will be described.

The present invention, the Arrow Modification and Fletching System 10 is comprised of a plurality of components. Such components are individually configured and correlated with respect to each other so as to attain the desired objective. In the broadest context an arrow modification and fletching system is essentially comprised of such components as an intermediate component functioning as an adapter, a rear component functioning as a fletching module and a front component have leading end having a point.

First provided is an intermediate component 30. The intermediate component functions as an adapter. The intermediate component is formed with a generally cylindrical body having a proximal end 32, a central portion 33 and a distal end 34. The proximal end is configured as a shaft insert with a generally hollow cylindrical. Approximately 70-80 percent of the exterior surface of the proximal end is knurled, channeled or otherwise textured. The proximal end is positionable within the hollow recess of a standard arrow shaft. The distal end of the intermediate component is formed with a shank 38 and a threaded extension adapted to couple with the female screw threads of a female threaded shaft insert. The central portion has a generally hollow configuration and is formed with a flange 35. The flange is formed with a flat abutment on either side for the purpose of capping the arrow shaft and eliminating gaps when assembled. The flange is formed with a recessed groove 36 in the distal edge capable of receiving an O-ring. An O-ring 37 is removably positioned in the groove providing a frictional locking mechanism.

Additionally provided is a rear component. The rear component functions as a fletching module. The rear component 20 has with a leading end 21 forwardly and a trailing end 22 rearwardly. The rear component has a cylindrical surface and a length between the forward end and the trailing end forming a shaft. The shaft of the rear component has the same I.D. of any normal arrow shaft. Fletching 24 is adhesively attached to the surface of the rear component and extends radially from the shaft between the leading end of the rear component and the trailing end of the rear component. The trailing end of the rear component has a nock 23. The leading end of the rear component is adapted to receive the shaft insert formed by the proximal end of the intermediate component. The shaft insert formed by the proximal end of the intermediate component is adhesively attached to the leading end of the rear component.

Lastly provided is a front component having a front shaft in a hollow cylindrical configuration with a leading end 11 forwardly and a trailing end 12 rearwardly. The leading end has an arrow head. The trailing end has an open configuration with an interior diameter and an exterior diameter. The interior diameter of the open end of the trailing end is adapted to receive a shaft insert. A shaft insert 15 formed with female screw threads is adhesively mounted in the open end of the trailing end of the forward component.

This configuration allows for the convenient removal and replacement of the fletching end of the arrow when damaged by simply unscrewing the rear fletching module and replacing with a new pre-built rear fletching module.

The invention also includes the method of using the systems as described above. The method is a method of arrow modification and fletching repair and replacement. The modification, repair and replacement being is done in a safe, convenient, efficient and economical manner, the method comprising, in combination, the steps as follows:

a. Providing an arrow having a shaft with a leading end forwardly and a trailing end rearwardly, the shaft having a hollow cylindrical configuration.

b. Providing a shaft insert formed with female threads.

c. Cutting the shaft perpendicular to the length between the leading end and the trailing end, the leading end forming a proximal shaft and the trailing end forming a distal shaft.

d. Adhesively installing the female insert into the open end of the proximal shaft.

e. Providing a fletching module with a leading end forwardly and a trailing end rearwardly, the rear component having a cylindrical surface and a length between the forward end and the trailing end forming a shaft, fletching adhesively attached to and extending radially from the shaft between the leading end of the rear component and the trailing end of the rear component, the trailing end of the rear component having a nock, a shaft recess adjacent to the leading end being formed with a cylindrical section of a first interior diameter adapted to receive the shaft insert, the leading edge configured with an adapter, the adapter having a generally cylindrical body having a proximal end, a central portion and a distal end, the proximal end being formed in a generally hollow cylindrical configuration with an interior surface and an exterior surface, the proximal end having 70to 80 percent of the exterior surface being knurled, the proximal end forming a shaft insert, the distal end having a shank and a threaded extension adapted to couple with the female screw threads of a female threaded shaft insert, the proximal end of the adapter adhesively mounted in the shaft recess adjacent to the leading end of the fletching module, the central portion having a generally hollow cylindrical configuration, the central portion formed with a flange, the flange having a recessed groove formed in the distal edge capable of receiving an O-ring.

f. Providing an O-ring.

g. Placing the O-ring in the recessed groove formed in the distal edge of the flange.

h. Attaching the fletching module by threading the male threaded extension of the distal end of the adapter mounted in the leading end of the fletching module into the female threaded shaft insert installed in the proximal shaft, joining the distal shaft and the proximal shaft, the O-ring acting as a frictional locking mechanism.

i. Providing an adapter, the adapter having a generally cylindrical body having a proximal end, a central portion and a distal end, the proximal end being formed in a generally hollow cylindrical configuration with an interior surface and an exterior surface, the proximal end having 70 to 80 percent of the exterior surface being knurled, the proximal end forming a shaft insert, the distal end having a shank and a threaded extension adapted to couple with the female screw threads of a female threaded shaft insert, the central portion having a generally hollow cylindrical configuration, the central portion formed with a flange, the flange having a recessed groove formed in the distal edge capable of receiving an O-ring.

j. Providing an O-ring.

k. Placing the O-ring in the recessed groove formed in the distal edge of the flange.

l. Adhesively installing the shaft insert formed by the proximal end of the adapter into the open end of the distal shaft.

m. Removing the fletching module from the distal end of the arrow shaft by unscrewing the male adapter from the female insert in the proximal end.

n. Threading the male threaded extension of the distal end of the adapter into the female threaded shaft insert re-joining the distal shaft and the proximal shaft of the arrow, the O-ring acting as a frictional locking mechanism.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An arrow modification and fletching repair system comprising:

an intermediate component 30 functioning as an adapter, the intermediate component having a generally cylindrical body having a proximal end, a central portion and a distal end, the proximal end being formed in a generally hollow cylindrical configuration with an interior surface and an exterior surface, the proximal end having 70 to 80 percent of the exterior surface being textured, the proximal end forming a shaft insert, the distal end having a shank and a threaded extension adapted to couple with the female screw threads of a female threaded shaft insert, the central portion having a generally hollow cylindrical configuration, the central portion formed with a flange, the flange having a recessed groove formed in the distal edge capable of receiving an O-ring; and an O-ring removably positioned in the groove, the O-ring being fabricated of an elastomeric material.

2. The system set forth in claim 1 further comprising a rear component, the rear component functioning as a fletching module with a leading end forwardly and a trailing end rearwardly, the rear component having a cylindrical surface and a length between the forward end and the trailing end forming a shaft, fletching adhesively attached to and extending radially from the shaft between the leading end of the rear component and the trailing end of the rear component, the trailing end of the rear component having a nock, a shaft recess adjacent to the leading end being formed with a cylindrical section of a first interior diameter adapted to receive the shaft insert formed by the proximal end of the intermediate component.

3. An arrow modification and fletching system (10), the modification and fletch repair and replacement being done in a safe, convenient and economical manner, the system, comprising, in combination:

a front component having a front shaft in a hollow cylindrical configuration with a leading end (11) forwardly and a trailing end (12) rearwardly, the leading end having an arrow head, the trailing end having an open configuration, the open end of the trailing end having an interior diameter and an exterior diameter, the interior diameter of the open end of the trailing end adapted to receive a shaft insert;

a shaft insert (15) formed with female screw threads, the shaft insert mounted in the open end of the trailing end of the forward component;

a rear component (20) having a rear shaft in a hollow cylindrical configuration with a leading end (21) forwardly and a trailing end (22) rearwardly, the rear component having a length between the leading end and the trailing end, the rearward end of the rear component having a nock (23), fletching (24) adhesively attached to and extending radially from the rear shaft between the leading end of the rear component and the trailing end of the rear component, the leading end having an open configuration, the open end of the leading end having an exterior diameter and an interior diameter;

an intermediate assembly (30) located between the trailing end of the front component and the leading end of the rear component, the intermediate assembly functioning as an adapter, the adapter having a generally cylindrical body having a proximal end (32), a central portion (33) and a distal end (34), the proximal end being formed in a generally hollow cylindrical configuration with a smooth interior surface and an exterior surface, the proximal end having approximately 70 percent to 80 percent of the exterior surface being textured, the texture being chosen from the class consisting of knurled and channeled, the proximal end of the adapter positionable within the open end of the leading end of the rear component, the proximal end of the adapter being adhesively attached to the leading end of the rear component, the distal end having a shank (38) and a threaded extension adapted to be removably coupled with the female screw threads of the shaft insert mounted in the open end of the trailing end of the forward component, the central portion having a generally hollow cylindrical configuration, the central portion (33) formed with a flange (35), the flange having a recessed groove (36) formed in the distal edge capable of receiving an O-ring, the intermediate assembly being formed from a rigid material taken from a class of rigid materials including aluminum, titanium, steel and hard plastics; and an O-ring (37) removably positioned in the groove (36) and forming a frictional locking mechanism, the O-ring being fabricated of an elastomeric material.

4. A method for arrow modification and fletch repair and replacement, the method comprising the steps of:

Providing an arrow having a shaft with a leading end forwardly and a trailing end rearwardly, the shaft having a hollow cylindrical configuration;

providing a shaft insert formed with female threads;

cutting the shaft perpendicular to the length between the leading end and the trailing end, the leading end forming a proximal shaft and the trailing end forming a distal shaft;

adhesively installing the female insert into the open end of the proximal shaft;

providing a fletching module with a leading end forwardly and a trailing end rearwardly, the rear component having a cylindrical surface and a length between the forward end and the trailing end forming a shaft, fletching adhesively attached to and extending radially from the shaft between the leading end of the rear component and the trailing end of the rear component, the trailing end of the rear component having a nock, a shaft recess adjacent to the leading end being formed with a cylindrical section of a first interior diameter adapted to receive a shaft insert, the leading edge configured with an adapter, the adapter having a generally cylindrical body having a proximal end, a central portion and a distal end, the proximal end being formed in a generally hollow cylindrical configuration with an interior surface and an exterior surface, the proximal end having 70 to 80 percent of the exterior surface being knurled, the proximal end forming a shaft insert, the distal end having a shank and a threaded extension adapted to couple with the female screw threads of a female threaded shaft insert, the proximal end of the adapter adhesively mounted in the shaft recess adjacent to the leading end of the fletching module, the central portion having a generally hollow cylindrical configuration, the central portion formed with a flange, the flange having a recessed groove formed in the distal edge capable of receiving an O-ring;

providing an O-ring;

placing the O-ring in the recessed groove formed in the distal edge of the flange; and attaching the fletching module by threading the male threaded extension of the distal end of the adapter mounted in the leading end of the fletching module into the female threaded shaft insert installed in the proximal shaft, joining the distal shaft and the proximal shaft, the O-ring acting as a frictional locking mechanism.

5. The method as set forth in claim 4 further providing an adapter, the adapter having a generally cylindrical body having a proximal end, a central portion and a distal end, the proximal end being formed in a generally hollow cylindrical configuration with an interior surface and an exterior surface, the proximal end having 70 to 80 percent of the exterior surface being knurled, the proximal end forming a shaft insert, the distal end having a shank and a threaded extension adapted to couple with the female screw threads of a female threaded shaft insert, the central portion having a generally hollow cylindrical configuration, the central portion formed with a flange, the flange having a recessed groove formed in the distal edge capable of receiving an O-ring;

providing an O-ring;

placing the O-ring in the recessed groove formed in the distal edge of the flange;

adhesively installing the shaft insert formed by the proximal end of the adapter into the open end of the distal shaft;

removing the fletching module from the distal end of the arrow shaft by unscrewing the male adapter from the female insert in the proximal end; and threading the male threaded extension of the distal end of the adapter into the female threaded shaft insert re-joining the distal shaft and the proximal shaft of the arrow, the O-ring acting as a frictional locking mechanism.

* * * * *